US005154068A

United States Patent [19]

DiDomenico

[11] Patent Number: 5,154,068

[45] Date of Patent: Oct. 13, 1992

[54] PIERCED EARLOBE PROTECTOR

[76] Inventor: Joseph DiDomenico, 575 Mount Pleasant Ave., Providence, R.I. 02908

[21] Appl. No.: 695,940

[22] Filed: May 6, 1991

[51] Int. Cl.[5] ..... A44C 7/00

[52] U.S. Cl. ..... 63/12; 63/DIG. 3; 63/2

[58] Field of Search ..... 63/12, DIG. 3; 24/705

[56] References Cited

U.S. PATENT DOCUMENTS

| | | | |
|---|---|---|---|
| 161,853 | 4/1875 | Baker | 63/12 X |
| 983,598 | 2/1911 | Auerbach | 63/12 |
| 2,568,207 | 9/1951 | Spicher | 63/12 X |
| 3,910,065 | 10/1975 | Holt | 63/12 |
| 3,945,089 | 3/1976 | Gagnon | 63/12 X |
| 4,353,370 | 10/1982 | Evans | 63/12 X |
| 4,593,540 | 6/1986 | Cuvar et al. | 63/12 |
| 4,829,788 | 5/1989 | DiDomenico | 63/12 |
| 4,907,425 | 3/1990 | Elkin | 63/12 |
| 4,928,367 | 5/1990 | Seidman | 63/12 X |

FOREIGN PATENT DOCUMENTS

| | | | |
|---|---|---|---|
| 0276197 | 7/1988 | European Pat. Off. | 63/12 |
| 8809134 | 12/1988 | World Int. Prop. O. | 63/12 |

*Primary Examiner*—Renee S. Luebke
*Assistant Examiner*—Michael J. Milano
*Attorney, Agent, or Firm*—Salter, Michaelson & Benson

[57] ABSTRACT

Pierced earlobe protector for permanent mounting in a wearer's earlobe, comprising an elongated tube of hypoallergenic material positioned within the pierced opening in the wearer's lobe, an enlarged flange at one end of the tube adapted to abut one surface of the lobe, and an extension at the other end of the tube extending beyond the opposite surface of the lobe, and locking means positioned on said extension to secure the protector in position in the lobe for subsequent reception therethrough of a pierced earring post.

1 Claim, 1 Drawing Sheet

PIERCED EARLOBE PROTECTOR

BACKGROUND OF THE INVENTION

The present invention relates generally to pierced earrings, and is more specifically directed to the provision of a protector for a person's pierced earlobe in the nature of a protective tube that extends through the wearer's lobe but that is provided with means for retaining the protector on the wearer's lobe so that it is always there when the wearer wishes to put on a pierced earring.

Pierced earrings have long been popular since there is less likelihood of the earring becoming lost or inadvertently detached from the wearer's ear than is the case with so-called clip-on earrings wherein the earring is retained on the wearer's lobe by means of a spring-loaded clip arm. Quite obviously, earrings of the clip-on type are more subject to accidental removal from the wearer's ear and hence are more likely to become lost, thus making it somewhat impractical to provide earrings of any real value utilizing the clip-on type mounting.

In addition, once one overcomes the initial discomfort of having one's ear pierced, pierced earrings are actually more comfortable to the wearer than clip-on type earrings, since the latter must necessarily exert a constant pressure on the wearer's lobe, which frequently can become quite uncomfortable.

However, a longstanding problem with pierced earrings is the fact that irritation and infection may sometimes result from the engagement of the pierced earring post, which is usually metallic, with the wearer's earlobe as the post extends therethrough. This is particularly true where a plated metal is utilized, since such platings frequently utilize nickel as a brightener, and nickel has long exhibited a tendency to promote irritation and even infection when in contact with the wearer's earlobe.

Efforts have been made to overcome this problem by utilizing earring posts that are hypoallergenic, such as posts of surgical steel or precious metals, but this is not always feasible, and not always completely successful in eliminating the aforesaid irritation and infection problems.

Another approach that has been tried has been to provide a hypoallergenic lining, such as tubular plastic, that surrounds the metallic post of the pierced earring so as to provide a hypoallergenic barrier between the post and the wearer's ear. U.S. Pat. No. 4,067,341 dated Jan. 10, 1978 to Ivey is illustrative of this technique, but the problem with the Ivey patent is that the tubular protector is mounted on the post or wire of the earring and then is inserted through the wearer's pierced lobe as a unit. Thus, there is no teaching or suggestion in the Ivey patent of permanently or at least semi-permanently mounting the protective tube in the wearer's lobe so that it will always be there when the wearer wishes to put on a pair of pierced earrings.

Edge U.S. Pat. No. 113,031 dated Mar. 28, 1871 and Handerson U.S. Pat. No. 2,713,863 dated Jul. 26, 1955 are other patents that broadly teach the concept of utilizing some kind of tubular means within the wearer's pierced earlobe that in effect serves as a lining for the piercing in the wearer's ear, but neither of these patents teach or suggest use of a hypoallergenic liner, nor do they teach a liner which is semi-permanently mounted on the wearer's lobe in the structural way that applicant's protector is mounted.

SUMMARY OF THE INVENTION

It is therefore an object of this invention to provide a protector for pierced earlobes that provides a hypoallergenic barrier between the earlobe and the metallic post of a pierced earring, and wherein the mounting of the protector on the wearer's lobe is such that the protector is permanently, or at least semi-permanently, retained thereon.

Another object of my invention is the provision of a protector for pierced ears that may be effectively mounted in a permanent or at least semi-permanent manner on earlobes of varying thickness.

Still another object of my invention is the provision of a protector or liner for pierced ears which when once mounted in the wearer's lobe is capable of receiving standard pierced earrings both of the post and hoop type.

Another object is the provision of a protector or liner for pierced ears that is relatively simple and economically feasible to manufacture, that promotes maximum comfort and protection to the wearer, and that is durable and long lasting in use.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention.

PREFERRED EMBODIMENT OF THE INVENTION

Figure 1:
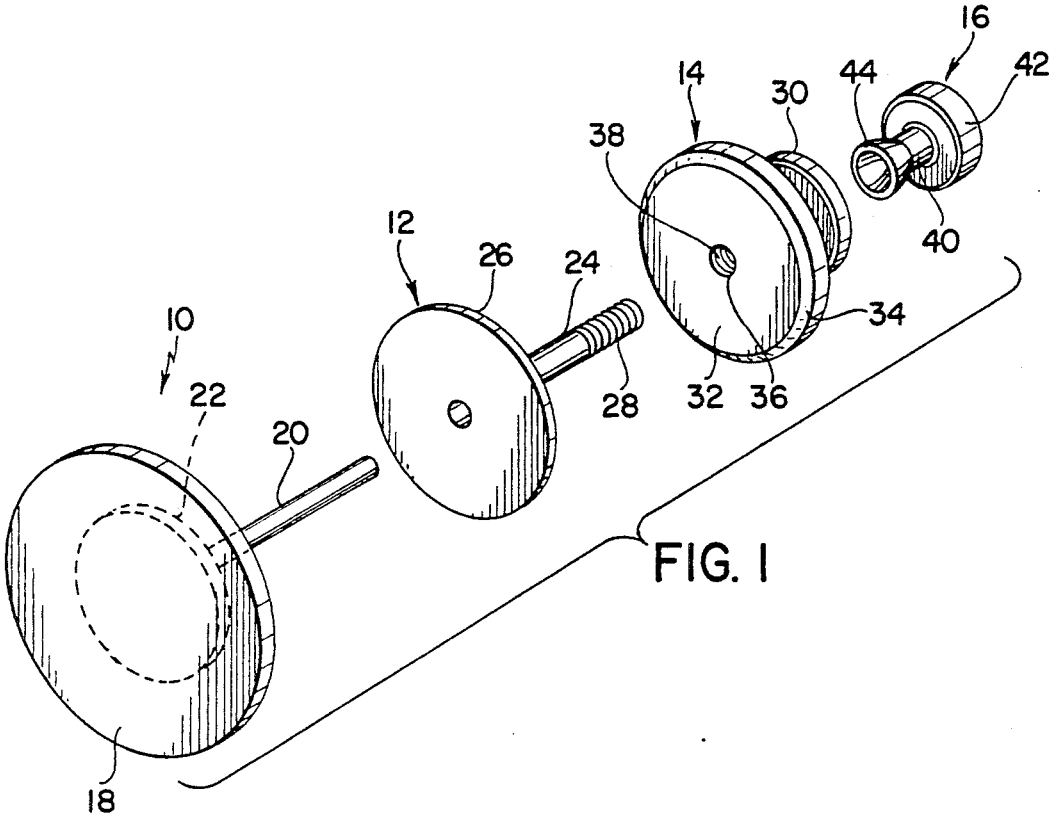
FIG. 1 is an exploded perspective view showing the protector of the instant invention in combination with a pierced earring.

Referring to FIG. 1, a pierced earring is shown generally at 10; a pierced ear protector is shown generally at 12; the locking means for the protector 12 is shown generally at 14; and a specially designed clutch member is shown generally at 16.

The pierced earring 10 is of conventional construction and comprises an ornamental portion 18 which is illustrated as being a circular disc and which may have any desired ornamentation (not shown) applied to its outer surface. A metallic post 20 extends from the inner surface of disc 18, and to facilitate assembly of the post 20 to the disc 18, the post 20 is secured to a circular flange 22 that in turn is secured to the inner surface of disc 18 by any suitable means, such as welding, cementing, etc. Obviously the flange 22 could be eliminated and the post 20 connected directly to the inner surface of disc 18, if so desired.

The protector 12 is constructed of any hypoallergenic material, preferably a pliant plastic material which lends itself to manufacture by any conventional molding techniques. The member 12 comprises an elongated tube 24 open at both of its extremities, having a circular flange 26 at one end thereof and having a serrated extension 28 at its opposite end.

The locking means 14, which is also preferably constructed of a moldable plastic material, comprises a hub portion 30 at its rearward end and a circular flange 32 at its forward end, said flange having a marginal bevel 34. An internal bore 36 extends axially through the member 14 and is internally serrated as at 38. It will be understood that the bore 36 is dimensioned so as to effect a frictional press-fit when forced onto the serrated extension 28 of tube 24. The serrations are provided to enhance the frictional interlock between tube 24 and locking means 14, although it will be understood that these surfaces could be knurled or otherwise roughened to effect the desired interlock, or such serrations or roughened portions could be entirely eliminated if the dimensional fit between locking means 14 and tube 24 is sufficient to provide a secure locking interengagement.

Clutch member 16, preferably constructed of any resilient material, such as plastic or rubber, comprises a body portion 40 having an enlarged circular portion 42 at its rear extremity, and an open-ended cup-shaped portion 44 at its forward extremity. A blind bore 46 extends through the clutch member 16, terminating in spaced relation to the surface 48 of circular portion 42. The bore 46 is dimensioned so as to frictionally receive post 20 of the pierced earring 10.

Figure 2:
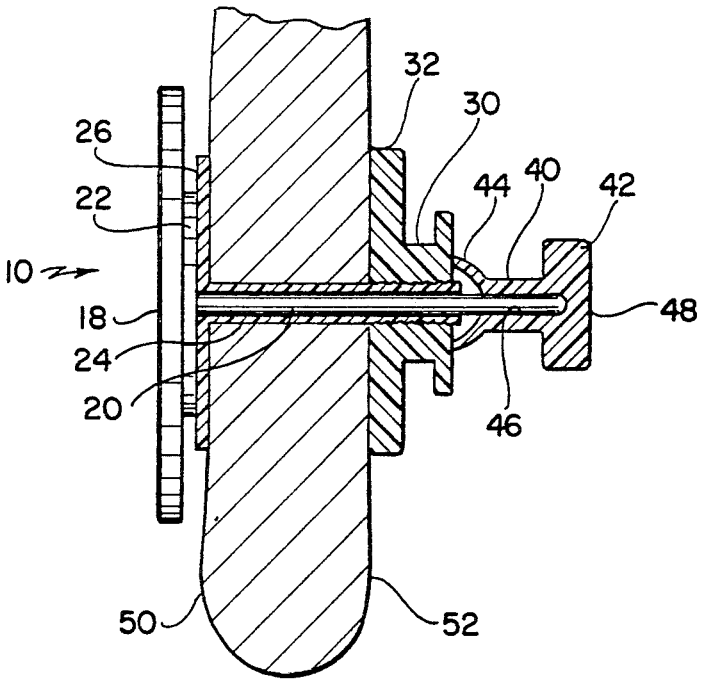
FIG. 2 is a sectional view showing the earring and protector combination of FIG. 1 in operative position on a wearer's earlobe.

In operation and use, and after the wearer's ear has been suitably pierced by known techniques, the protector 12 is inserted through the wearer's pierced lobe, it being understood that protector 12 is inserted into the wearer's ear until flange 26 abuts the outer surface 50 of the wearer's lobe, as illustrated in FIG. 2, at which point the tube 14 will have extended completely through the wearer's lobe with the extension 28 extending beyond the inner surface 52 of the lobe. At this point the locking means 14 is pressed on extension 28 of tube 14 until the front surface of flange 32 snugly but comfortably engages against rear lobe surface 52, it being understood that marginal bevel 34 eliminates any sharp corner that might otherwise cause discomfort. The frictional interengagement of the serrated extension 28 with the internal serrations 38 in bore 36 effects a firm locking engagement between member 14 and protector 12 so as to firmly retain the assembly on the wearer's ear. Now whenever the wearer wishes to put on a particular pair of pierced earrings, it is simply necessary to take the earring 10 and insert its post 20 through the internal bore of tube 24, it being understood that the dimension of post 20 is such as to be freely and slidably received within said bore, it being further noted that the length of post 20 is such that it extends beyond extension 28, as illustrated clearly in FIG. 2. At this point clutch member 16 is forced onto the exposed end of post 20 to retain the earring 10 in its mounted position. Since the bore 46 which receives the end of post 20 is a blind bore, the end of the post is covered so as to minimize any possible discomfort that might exist if the end of the post were exposed. Preferably the clutch 16 completely covers the exposed end of post 20, it being noted that the cup-shaped extension 44 surrounds and covers the terminal end of serrated extension 28. Although it has been found desirable to completely cover the entire exposed end of post 20, such is not absolutely essential, and hence any conventional frictional clutch could be assembled onto the end of post 20, although preferably the end of post 20 will always be covered.

Although a prime objective of my invention is to provide a protector that remains in the wearer's lobe so that it is always there when the wearer wishes to put on a particular pair of pierced earrings, it will nevertheless be apparent that if for any reason it should become necessary or desirable to remove the protector 12 from the wearer's ear, the locking means 14 could be forceably pulled off of tube 24 so as to permit removal of protector 12 from the wearer's ear.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In combination, a pierced earlobe protector comprising an elongated tube of hypoallergenic material adapted to be positioned within a person's pierced earlobe, a radially extending flange at one end of said tube adapted to abut the outer surface of the person's lobe, and extension at the opposite end of said tube adapted to extend beyond the inner surface of the person's lobe, and locking means positioned on said extension to secure the protector in the lobe, the combination further comprising a pierced earring having an ornament and a post extending therefrom, said post being slidably received within said tube and having an end portion that extends beyond said tube extension when said ornament is positioned adjacent said radial flange, and clutch means in releasable engagement with said post end portion for retaining said earring in operative position, said locking means comprising a circular flange engaging the inner surface of the wearer's lobe, said clutch means comprising a body portion having a blind bore therein that frictionally receives said post, said clutch further having a hollow cup-shaped portion that resiliently engages said locking means, whereby any portion of said extension that extends beyond said locking means, as well as the entire end of said post that extends beyond said extension, are completely covered, the edge of the circular flange that is in engagement with the wearer's lobe being beveled.

* * * * *